United States Patent [19]

Chen

[11] Patent Number: 4,790,532

[45] Date of Patent: Dec. 13, 1988

[54] TOY FISHING PLAY UNIT WITH MULTIPLE TURNING DISCS

[76] Inventor: Tsan-Ling Chen, No. 14, Hsin Ping Road, An Ping Industrial Zone, Tainan, Taiwan

[21] Appl. No.: 121,273

[22] Filed: Nov. 16, 1987

[51] Int. Cl.[4] ..... A63B 67/00; A63F 71/00

[52] U.S. Cl. ..... 273/1 GE; 273/140; 273/1 GG

[58] Field of Search ..... 273/1 R, 1 GD, 140, 273/1 GE, 1 GG; 446/236

[56] References Cited

U.S. PATENT DOCUMENTS 4,214,750 7/1980 Shimiza ..... 273/1 M
4,603,860 8/1986 Wey ..... 273/1 GD

FOREIGN PATENT DOCUMENTS 2422878 12/1979 France ..... 273/1 GB
1186225 10/1985 U.S.S.R. ..... 273/1 R
12285 of 1911 United Kingdom ..... 273/140

*Primary Examiner*—Richard C. Pinkham
*Assistant Examiner*—Gary Jackson
*Attorney, Agent, or Firm*—Larson & Taylor

[57] ABSTRACT

A toy fishing play unit with multiple turning discs containing a base plate mounted with a big turning disc provided with a number of recessed holes for settling therein small turning discs which can be turned around simultaneously together with the big turning disc by a motor by means of transmitting gears set among those turning discs.

1 Claim, 3 Drawing Sheets

TOY FISHING PLAY UNIT WITH MULTIPLE TURNING DISCS

BACKGROUND OF THE INVENTION

Ordinary toy fishing play units such as one patented of U.S. Pat. No. 4,224,261 has a turning disc mounted on a base plate provided with model fish placed in a number of cells and a player uses a fishing rod fastened with a string bound with a bait at its free end trying to fish up model fish. It can only be played by one child at a time, but is impossible for two or more children to play at the same time. Although it gives a child some interest, but not a sense of competitiveness.

SUMMARY OF THE INVENTION

Therefore, the inventor has worked out this new toy fishing play unit with multiple turning discs which can be played by two or more children at the same time.

It consists of a base plate on which a big turning disc is mounted, and the big turning disc is provided with a plurality of round holes for mounting small turning discs which are combined with a gear between every two of them. The big turning disc has standing-up posts. Both the small and the big turning discs are turned by transmitting gears driven by a motor. Besides, a windmill is provided at the peripheral edge of the base plate being turned by the big turning disc, too.

DETAILED DESCRIPTION OF THE INVENTION

Figure 1:
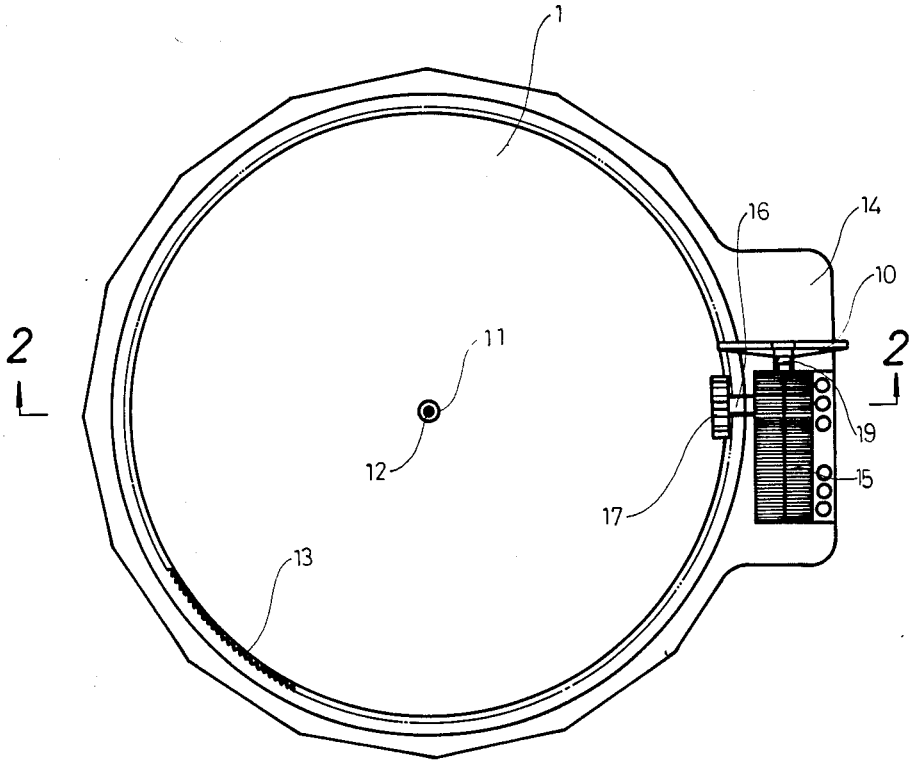
FIG. 1 is a plan view of the base plate in this invention.
Figure 2:
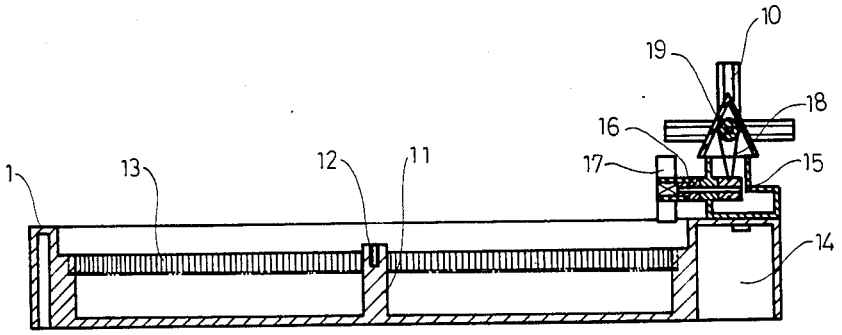
FIG. 2 is a cross-sectional view on line 2—2 of FIG. 1.

First, FIGS. 1 and 2 show the structure of base plate 1 of this toy fishing play unit with multiple turning discs. Shaft 11 with a longitudinal screw hole 12 at its center is provided at the center of base plate 1, which has its inside periphery set with inside gear teeth 13 and an outwardly protruding base at its peripheral edge for mounting a housing 15 fixed with horizontal shaft 16. Said shaft 16 is connected with gear 17 at one end and with belt 18 at the other; said belt 18 is combined with longitudinal shaft 19 connected with propellers 10.

Figure 3:
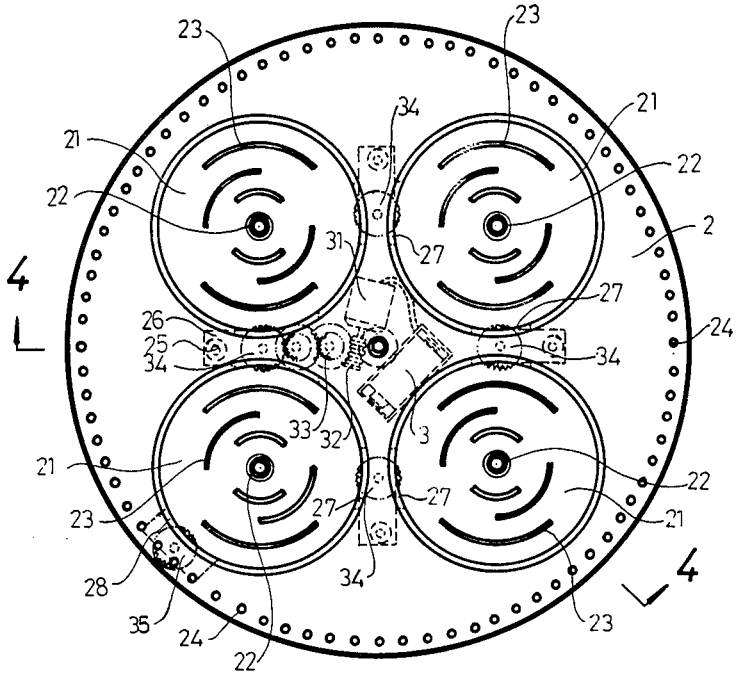
FIG. 3 is a plan view of the big turning disc in this invention.
Figure 4:
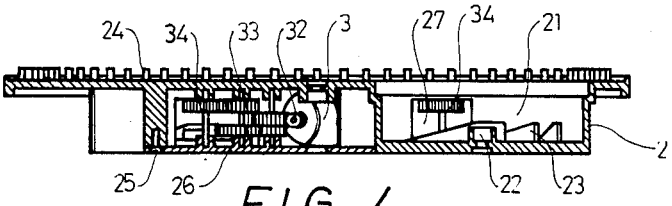
FIG. 4 is a cross-sectional view on line 4—4 of FIG. 3.

Next, FIGS. 3 and 4 show the structure of big turning disc in this unit. Big turning disc 2 is provided with four recessed holes 21, each hole 21 having shaft rod 22 at the center and a plurality of discontinuous upstanding ridges 23 which are arranged circumferentially and irregularly, and a plurality of posts 24 arranged located circumferentially near the edge with the same distance among them. Besides, at the bottom of big turning disc 2 is set plate 26 for storing one dry battery 3 as the source of electricity to drive motor 31. Worm 32 is fixed on the shaft of motor 31, engaging with gear group 33. Notch 27 is provided at the nearest edge of each recessed hole 21 to the adjacent recessed hole 21 and each transmitting gear 34 extends through two notches 27 and into two recessed holes 21. Only one of the four transmitting gears 34 engages with gear group 33, and only one of the four recessed holes 21 is provided with notch 28 at the nearest edge to big turning disc 2 for transmitting gear 35 to partly extend in. Transmitting gear 35 also engages with inner periheral teeth 13 of base plate 1 as shown in FIG. 7.

Figure 5:
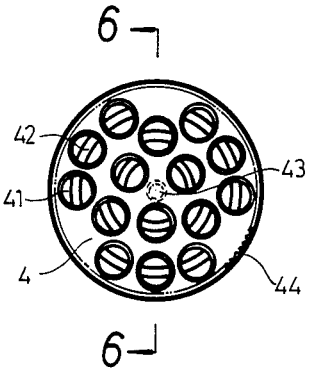
FIG. 5 is a plan view of the small turning disc in this invention.
Figure 6:
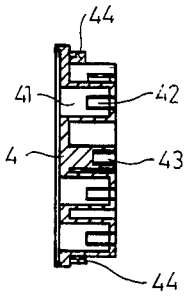
FIG. 6 is a cross-sectional view on line 6—6 of FIG. 5.

Next, small turning disc 4, as shown in FIGS. 5 and 6, is set in recessed hole 21 of big turning disc 2, having a plurality of cells 41 whose bottom is bored with curve slots located correspondingly with ridges 23 set in big turning disc 2. A screw hole 43 is provided in the central bottom of small turning disc for a screw to screw in, and thus small turning disc can only turn around in recessed hole 21 of big turning disc 2. Besides, each small turning disc 4 is provided with peripheral teeth 44 which engage with each transmitting gear 34 or 35 after it is set in each recessed hole 21.

Figure 7:
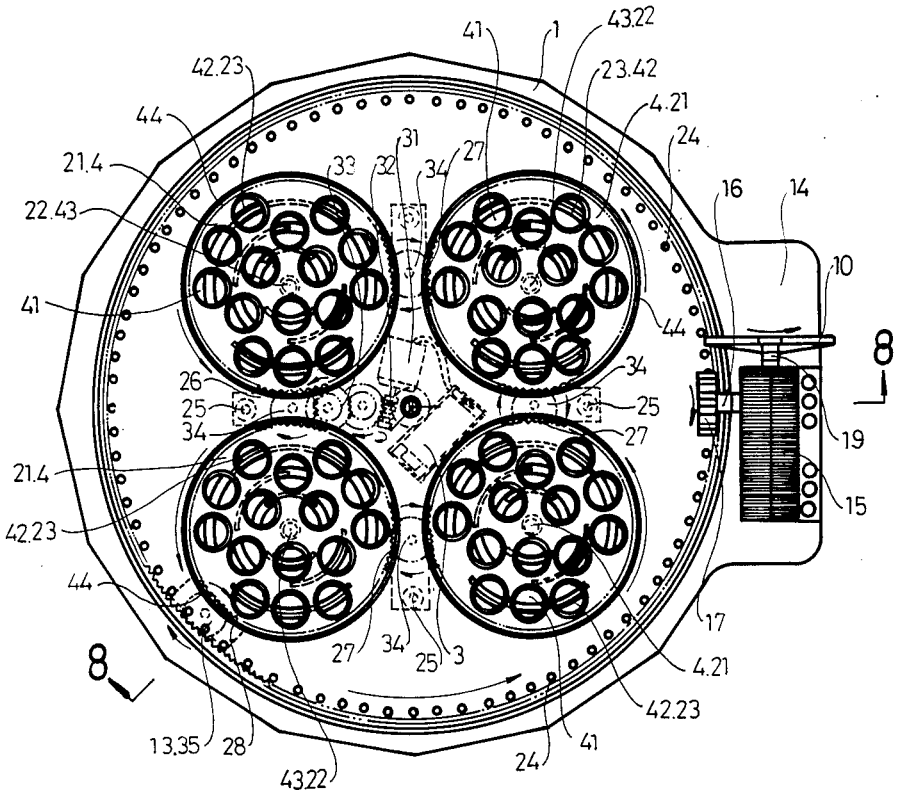
FIG. 7 is a plan view of the toy fishing play unit in this invention.
Figure 8:
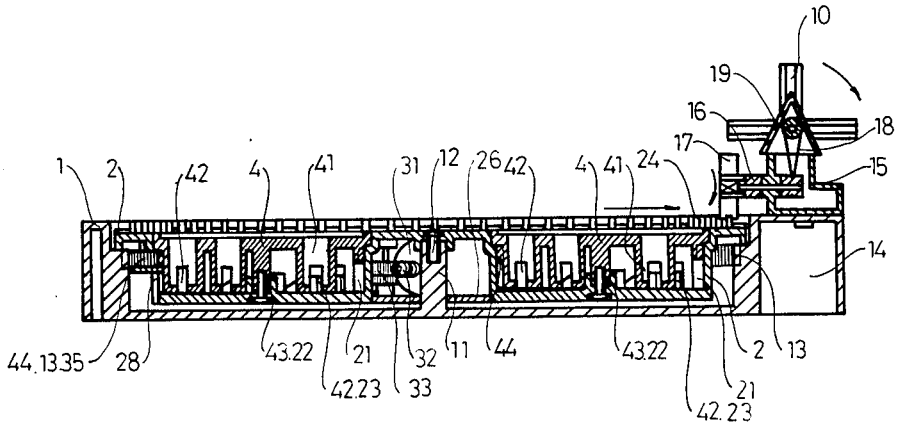
FIG. 8 is a cross-sectional view on line 8—8 of FIG. 7.

Next, as FIG. 7 shows, after motor 31 has been started to turn by dry battery 3, its revolution is orderly transmitted to worm 32, gear group 33 and gear 34 which turn all of small turning discs 4 correlatingly. Accordingly gear 35 can be turned by the correlative movement of small turning discs and big turning disc 2 can also be turned by gear 35 as gear 35 engages with inner peripheral teeth 13 of base plate 1. Therefore, the turning of big turning disc 2 can cause posts 24 to turn gear 17, which in turn transmits movement to belt 18 and then to propellers 10 of the windmill.

Lastly, ridges 23 set in big turning disc 2 can pass through curve slots 42 lifting up the model fish 1 put in cells 41 of small turning discs 4 when said small discs 4 is turned. So the new plan of this invention consists in the plurality of small turning discs and the setting of a windmill.

What is claimed is:

1. A toy fishing play unit with multiple turning discs comprising:

a base plate which is provided with a shaft at the center of its surface;

a big turning disc having a plurality of recessed holes and being rotatably mounted on said base plate;

small turning discs with peripheral teeth turnably mounted in respective ones of said recessed holes;

a notch cut in the wall forming each recessed hole at the place where each recessed hole is nearest to the other;

transmitting gears extending in and engaging with said peripheral teeth of every two small turning discs;

a plurality of posts arranged near the peripheral edge of said big turning disc to engage with a gear mounted on said base plate;

a horizontal shaft connected with said gear at one end and with an endless belt at the other end;

a longitudinal shaft moutning the propellers of a windmill, said shaft adapted to be turned by said endless belt;

peripheral teeth on said base plate adapted to engage with a gear which is also engaged with the peripheral teeth of one of said small turning discs for transmitting revolutions from said small turning disc to the big turning disc;

an electric motor mounted on said big turning disc, and gear means connecting said electric motor to one of said small turning discs.

* * * * *